US006748914B2

(12) United States Patent
Spath et al.

(10) Patent No.: US 6,748,914 B2
(45) Date of Patent: Jun. 15, 2004

(54) REFILLABLE METERING VALVE FOR HYDRAULIC VALVE LIFTERS

(75) Inventors: Mark J. Spath, Spencerport, NY (US); Carl R. Kangas, Sand Lake, MI (US)

(73) Assignee: Delphi Technologies, Inc., Troy, MI (US)

( * ) Notice: Subject to any disclaimer, the term of this patent is extended or adjusted under 35 U.S.C. 154(b) by 101 days.

(21) Appl. No.: 10/113,466

(22) Filed: Mar. 29, 2002

(65) Prior Publication Data

US 2002/0096136 A1 Jul. 25, 2002

Related U.S. Application Data

(63) Continuation-in-part of application No. 09/840,375, filed on Apr. 23, 2001, which is a continuation-in-part of application No. 09/693,452, filed on Oct. 20, 2000.

(51) Int. Cl.[7] ..... F01L 1/14

(52) U.S. Cl. ..... 123/90.53; 123/90.55; 123/90.56; 123/90.57

(58) Field of Search ..... 123/90.48, 90.49, 123/90.5, 90.51, 90.52, 90.53, 90.54, 90.55, 90.56, 90.57, 90.58, 90.59, 90.12, 90.15, 90.16, 90.17, 90.39, 90.4, 90.41, 90.42, 90.43, 90.44, 90.45, 90.46, 90.47; 74/569

(56) References Cited

U.S. PATENT DOCUMENTS 4,054,109 A * 10/1977 Herrin et al. ..... 123/90.16
4,083,334 A * 4/1978 Roncon ..... 123/90.35
4,133,332 A * 1/1979 Benson et al. ..... 123/198 F
4,164,917 A * 8/1979 Glasson ..... 123/321
6,318,324 B1 * 11/2001 Koeroghlian et al. .... 123/90.55

* cited by examiner

*Primary Examiner*—Thomas Denion
*Assistant Examiner*—Jaime Corrigan
(74) *Attorney, Agent, or Firm*—Patrick M. Griffin

(57) ABSTRACT

Oil metering valve means in a hydraulic valve lifter configured such that a metering plate cooperates with a pushrod seat to meter the flow of oil in a forward direction. The metering means is also conducive to the flow of oil in the reverse direction, permitting an oil reservoir in the lifter to be filled by reverse oil flow, either after assembly of the lifter or upon engine shutdown. Embodiments of such oil metering valve means may include: a metering plate having one or more notches around its periphery to permit oil to flow past the plate and a feature supporting the plate; a metering plate having one or more apertures to permit oil to flow through the plate; a metering plate having one or more nonplanar areas along the edges of the plate to prevent sealing of the plate against the supportive feature; and a metering-plate supportive feature having one or more irregularities, such as grooves, bumps, or undulations to permit flow around the edge of the plate past the irregularities.

16 Claims, 5 Drawing Sheets

REFILLABLE METERING VALVE FOR HYDRAULIC VALVE LIFTERS

CROSS-REFERENCE TO RELATED APPLICATIONS

This application is a continuation-in-part of a U.S. patent application, Ser. No. 09/840,375, filed Apr. 23, 2001, which is a continuation-in-part of a U.S. patent application, Ser. No. 09/693,452, filed Oct. 20, 2000.

TECHNICAL FIELD

The present invention relates to hydraulic valve lifters for internal combustion engines; more particularly, to hydraulic valve lifters filled with oil during manufacture; and most particularly, to hydraulic valve lifters which are refillable after assembly to ensure a desired volume of fill oil.

BACKGROUND OF THE INVENTION

Hydraulic valve lifters are well known in the internal combustion engine art, especially for pushrod-type engines wherein a cam-actuated lifter, acting on a pushrod, actuates a valve stem via an intermediate rocker arm. A lifter for each intake and exhaust valve is slidingly disposed in the engine block between the pushrod and its corresponding cam lobe and translates the cam rotary motion into pushrod linear motion to open and close the valve. Typically, a hydraulic lifter has an outer body actuated by the cam lobe, which body may contain a roller for riding on the cam. The outer body is hollow and defines a well, opening away from the cam lobe and containing a close-fitting plunger which is axially slidable within the well. The upper end of the plunger is closed by a hollow seat for supporting a spherical end of the pushrod. Engine oil under pressure is provided, via a port in the outer body to a low-pressure chamber within the plunger. A check valve connects the low-pressure chamber to a high-pressure chamber formed between the bottom of the well and the plunger, which chamber is expanded by a plunger spring to urge the plunger axially with respect to the well until all mechanical lash in the train between the cam lobe and the valve stem is eliminated, thus rendering the train compressionally rigid. Typically, with each compressive stroke of the lifter, a small amount of oil is expressed from the high pressure chamber, which amount is replaced during the recovery portion of the stroke from the low-pressure chamber via the check valve.

The low-pressure chamber also opens onto the pushrod seat for providing engine oil to the engine rocker arm assembly, via axial passages in the seat, the ball end, and the pushrod. To maintain high oil pressure in the rest of the oil supply system, a simple metering valve is provided in the lifter. The oil-entry side of the pushrod seat is formed having a transverse cylindrical surface, the pushrod seat oil passage opening into the curved surface. A disk-shaped metering plate is supported within the plunger by an annular feature formed at the upper end of the low-pressure chamber between the low-pressure chamber and the pushrod seat. The plate is permitted an axial range of motion between the seat and the annular feature. Oil flowing upwards from the low-pressure chamber to the pushrod urges the plate against the entry to the pushrod seat oil passage which thus becomes partially but not fully sealed by the plate because the cylindrical surface curves away from the plate. Thus, a predetermined leakage area is established between the metering plate and the pushrod seat. Sufficient oil is passed to lubricate the engine top elements, while the engine oil pressure is maintained. When the engine is shut off, oil flow stops and the plate settles by gravity onto the annular feature, forming a check valve against gravity drainage of oil from the pushrod.

There are at least two circumstances wherein the check valve action of the metering plate can be undesirable.

First, pushrod lifters may be used in V-style engines, wherein the lifters are canted at an angle from vertical. This orientation can allow oil in the low-pressure chamber to drain back into the engine via the oil supply port when the engine is shut off. Significant noise from mechanical lash can result at the ensuing engine startup, until the lifter is refilled from the engine oil supply. The volume of oil retained within the pushrod is relatively large, but because of the check-valve action of the metering plate on the annular feature, this pushrod reservoir is trapped in the pushrod and is not available to drain into the low-pressure chamber by gravity flow during periods of engine inactivity.

Second, prior to shipment of lifters from a manufacturing facility to an engine assembly site, typically the high-pressure chamber is filled with a low-viscosity fluid such as kerosene and the low-pressure chamber is filled with a low-viscosity oil such as 5W30 grade. During assembly of the lifter, especially a valve-deactivating lifter, it is a known problem to lose some of these fluids such that, when ready for shipment, the low-pressure chamber is only partially filled, which partial filling is not readily detected until installation in an engine. Such a deficient lifter, when installed in an engine being assembled, will clatter upon actuation by the engine, resulting in immediate rejection of the engine on the assembly line. Such failure is very costly in terms of engine rework, and can result in an engine manufacturer's switching to a different supplier of lifters. In prior art hydraulic lifters, the check-valve action of the metering plate on the annular feature prevents injection of oil into the low-pressure chamber through the pushrod seat as a corrective measure after assembly of the lifter, as might be undertaken to ensure that the low-pressure chamber is correctly filled immediately prior to shipment.

It is a principal object of the present invention to provide an improved hydraulic valve lifter wherein a metering plate cooperating with retaining means in a low-pressure chamber is incapable of forming a reverse-flow check valve.

SUMMARY OF THE INVENTION

Briefly described, an improved oil metering valve means in a hydraulic valve lifter is configured such that a metering plate cooperates with a pushrod seat to meter the flow of oil in a first direction, as in the prior art. The metering means is also conducive to the flow of oil in a second and reverse direction and does not define a reverse-flow check valve. Embodiments of such oil metering valve means may include, but are not limited to: a metering plate having one or more notches around its periphery to permit oil to flow past the plate and an annular feature supporting the plate; a metering plate having one or more apertures to permit oil to flow through the plate; a metering plate having one or more nonplanar areas along its edges to prevent sealing of the plate against the annular feature; and one or more irregularities in the annular feature, such as grooves, bumps, or undulations to permit flow around the edge of the plate.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
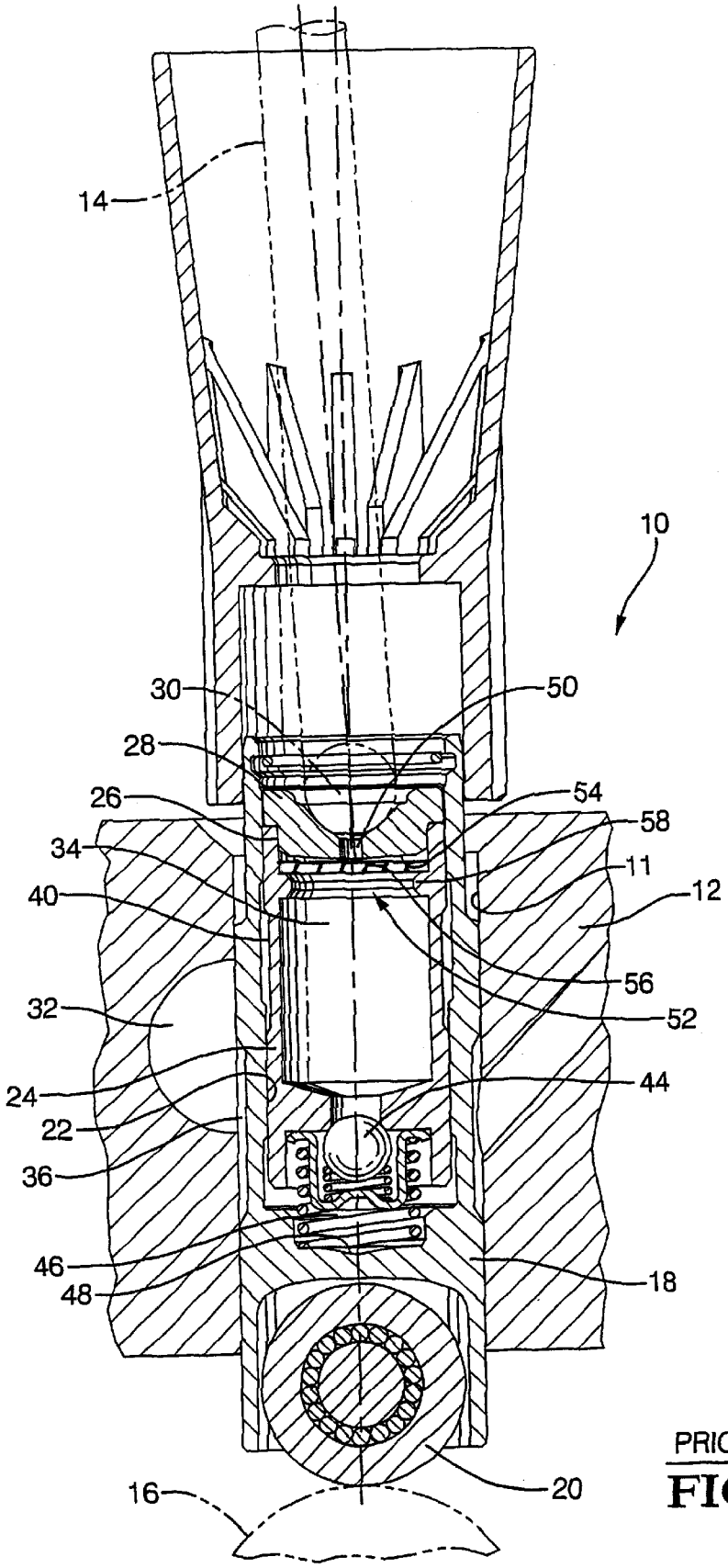
PRIOR ART FIG. 1
FIG. 1 is an elevational cross-sectional view of a prior art hydraulic valve lifter.
Figure 1A:
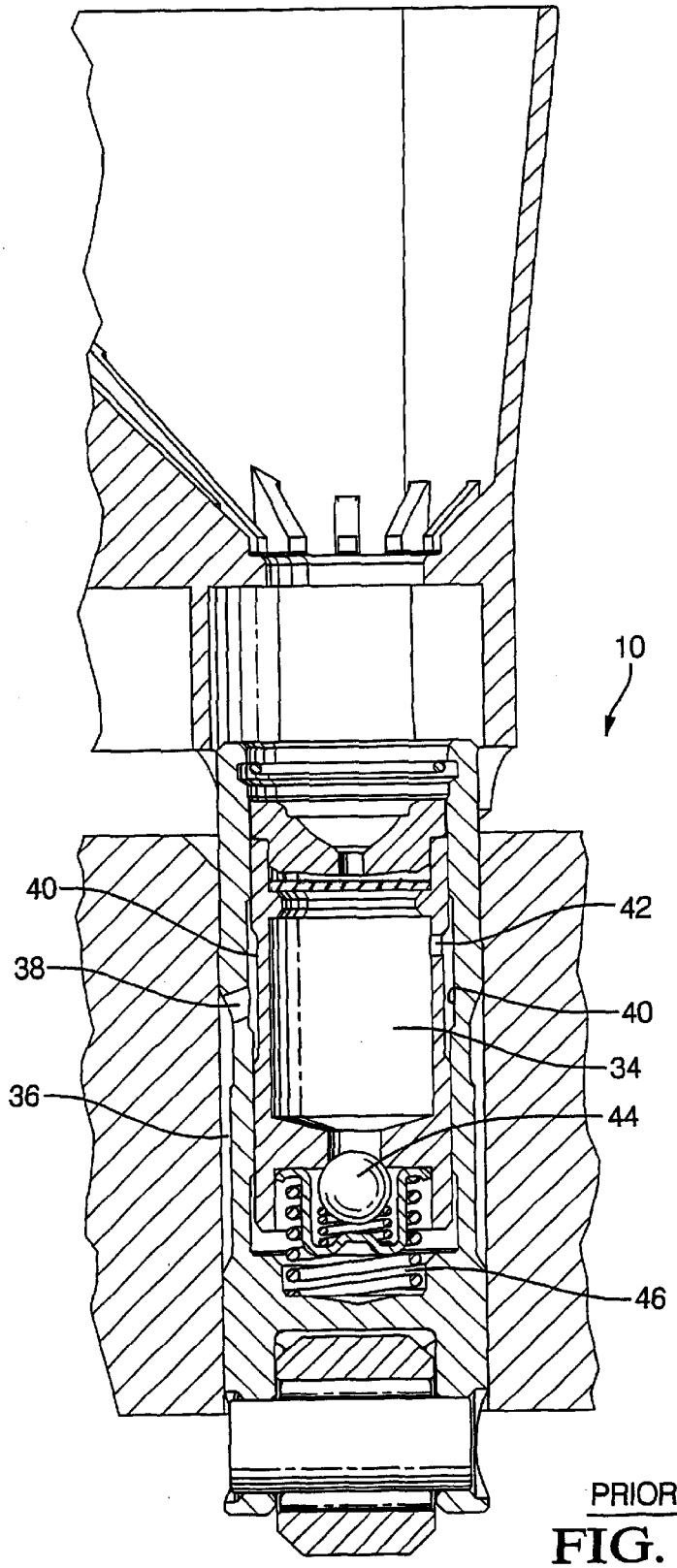
PRIOR ART FIG. 1 A
FIG. 1*a* is an elevation cross-sectional view of the lifter shown in FIG. 1, taken at 90° from that view.

Referring to FIGS. 1 and 1*a*, a first prior art hydraulic valve lifter (HVL) 10 is slidingly disposed in a bore 11 in an engine block 12 between a pushrod 14 and its corresponding cam lobe 16 and translates the cam rotary motion into pushrod linear motion to open and close an engine valve (not shown). Lifter 10 has an outer body 18 actuated by the cam lobe, which body may contain a roller 20 for riding on the cam. Outer body 18 is hollow and defines a well 22, opening away from the cam lobe and containing a close-fitting plunger 24 which is axially slidable within well 22. Upper end 26 of plunger 24 is closed by a seat 28 for supporting a spherical end 30 of pushrod 14. Engine oil under pressure is provided from an engine oil gallery 32 to a low-pressure chamber 34 within plunger 24 via a first annular distributor 36 formed in the surface of body 18, a first passage 38 connecting distributor 36 with a second annular distributor 40 formed in the surface of plunger 24, and a second passage 42 connecting distributor 40 with low-pressure chamber 34. A check valve 44 connects low-pressure chamber 34 to a high-pressure chamber 46 formed between the bottom 48 of well 22 and plunger 24, chamber 46 being expanded by a coil spring (not shown) to urge plunger 24 axially of well 22 until all mechanical lash in the train between the cam lobe and the valve stem is eliminated, thus rendering the train compressionally rigid due to the non-compressibility of the oil in chamber 46. With each compressive stroke of lifter 10, a small amount of oil is expressed from high-pressure chamber 46 back into second distributor 40, which amount is replaced during the recovery portion of the stroke from low-pressure chamber 34 via check valve 44.

Low-pressure chamber 34 also opens onto pushrod seat 28 for providing engine oil to the engine rocker arm assembly (not shown), via axial passages 50 in seat 28, in ball end 30, and internally of hollow pushrod 14.

A metering valve system 52 is provided in lifter 10 for providing lubricating oil at restricted flow to the rocker arm assembly from low-pressure chamber 34. The oil-entry side 54 of pushrod seat 28 is formed having a transverse cylindrical surface, the pushrod seat oil passage 50 opening into the curved surface. A disk-shaped metering plate 56 is supported within plunger 24 by supporting means 58, preferably an annular feature formed at the upper end of low-pressure chamber 34 between the low-pressure chamber and the pushrod seat. Metering plate 56 is permitted an axial range of motion between pushrod seat 28 and supporting means 58. Oil flowing in a first direction from low-pressure chamber 34 to pushrod 14 urges plate 56 against the entry to pushrod seat oil passage 50 which thus becomes partially but not fully sealed by the plate because the cylindrical surface of 54 curves away from the plate. Thus, a predetermined leakage area is established between metering plate 56 and pushrod seat 28. Sufficient oil is passed in a first direction to lubricate the engine top elements, while the engine oil pressure is maintained. When the engine is shut off, oil flow stops and metering plate 56 settles by gravity onto supporting feature 58.

In prior art lifter 10, when the engine is shut off, or the lifter is otherwise at rest, metering plate 56 settles onto supporting feature 58, thereby forming a check-valve seal against flow of oil in the reverse direction.

Figure 3:
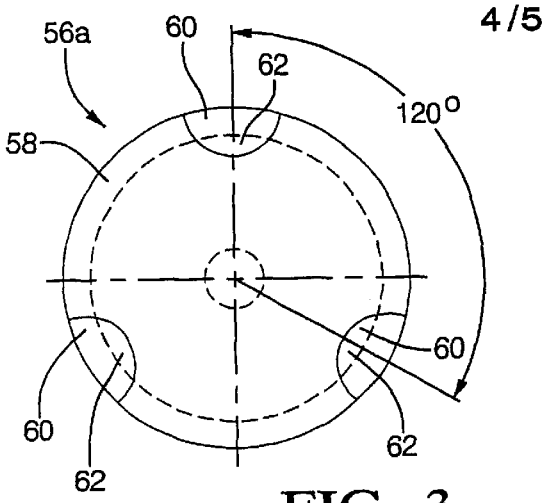
FIG. 3 is a plan view of a first embodiment of a metering plate in accordance with the invention for use in either of the lifters shown in FIGS. 1 and 2.
Figure 4:
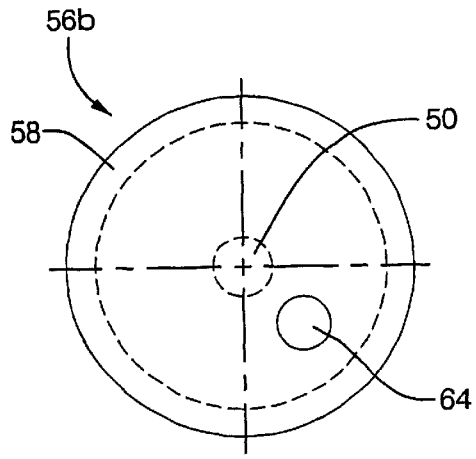
FIG. 4 is a plan view of a second embodiment of a metering plate.
Figure 5:
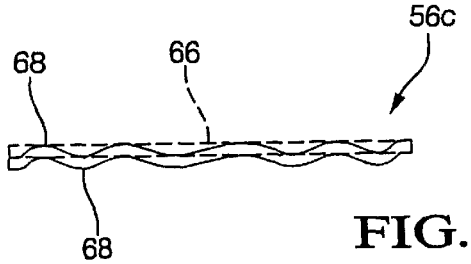
FIG. 5 is a side view of a third embodiment of a metering plate.

Referring to FIGS. 3 through 5, improved metering plates in accordance with the invention are shown. A lifter 10 provided with an oil metering-valve system 52 in accordance with the invention is able to draw on the oil reservoir contained in pushrod 14 to prevent undesirable net loss of oil from the lifter during periods of engine shutdown.

In FIG. 3, improved planar metering plate 56*a* includes at least one peripheral notch 60, and preferably three such notches disposed equilaterally at 120° internal angles, extending radially inwards a sufficient distance to provide flow orifices 62 between plate 56*a* and supporting feature 58, thereby permitting flow of oil through plate 56*a*.

In FIG. 4, improved planar metering plate 56*b* includes at least one aperture 64 for permitting oil flow therethrough. Aperture 64 is radially offset from axial passage 50 by a distance such that there is no overlap and the metering function of plate 56*a* in the forward oil flow direction is not compromised.

In FIG. 5, improved metering plate 56*c* includes a planar central portion 66 for metering against axial passage 50 as in the prior art, and at least one nonplanarity 68 formed along the periphery of plate 56*c* such that a seal cannot be formed against supporting feature 58.

Figure 6:
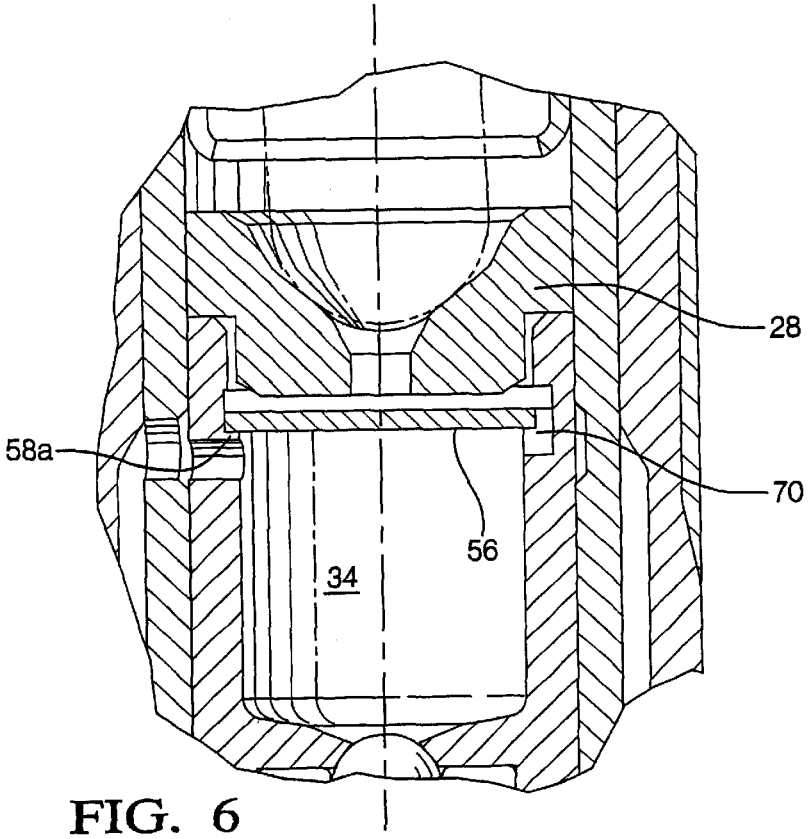
FIG. 6 is a an enlarged view of a portion within circle 6 of the lifter shown in FIG. 2, showing an irregularity in the annular feature supporting the metering plate in a fourth embodiment of the invention.

Referring to FIG. 6, check-valve sealing of a metering plate against supporting feature 58 may also be prevented by modification of feature 58 in any way which creates an non-sealable irregularity 70, shown in FIG. 6 as a groove through feature 58. Other examples within the scope of the invention include bumps on improved feature 58*a* and circumferential undulation of feature 58*a*, all of which will prevent sealing of a prior art planar metering plate 56 against supporting feature 58*a*.

Figure 2:
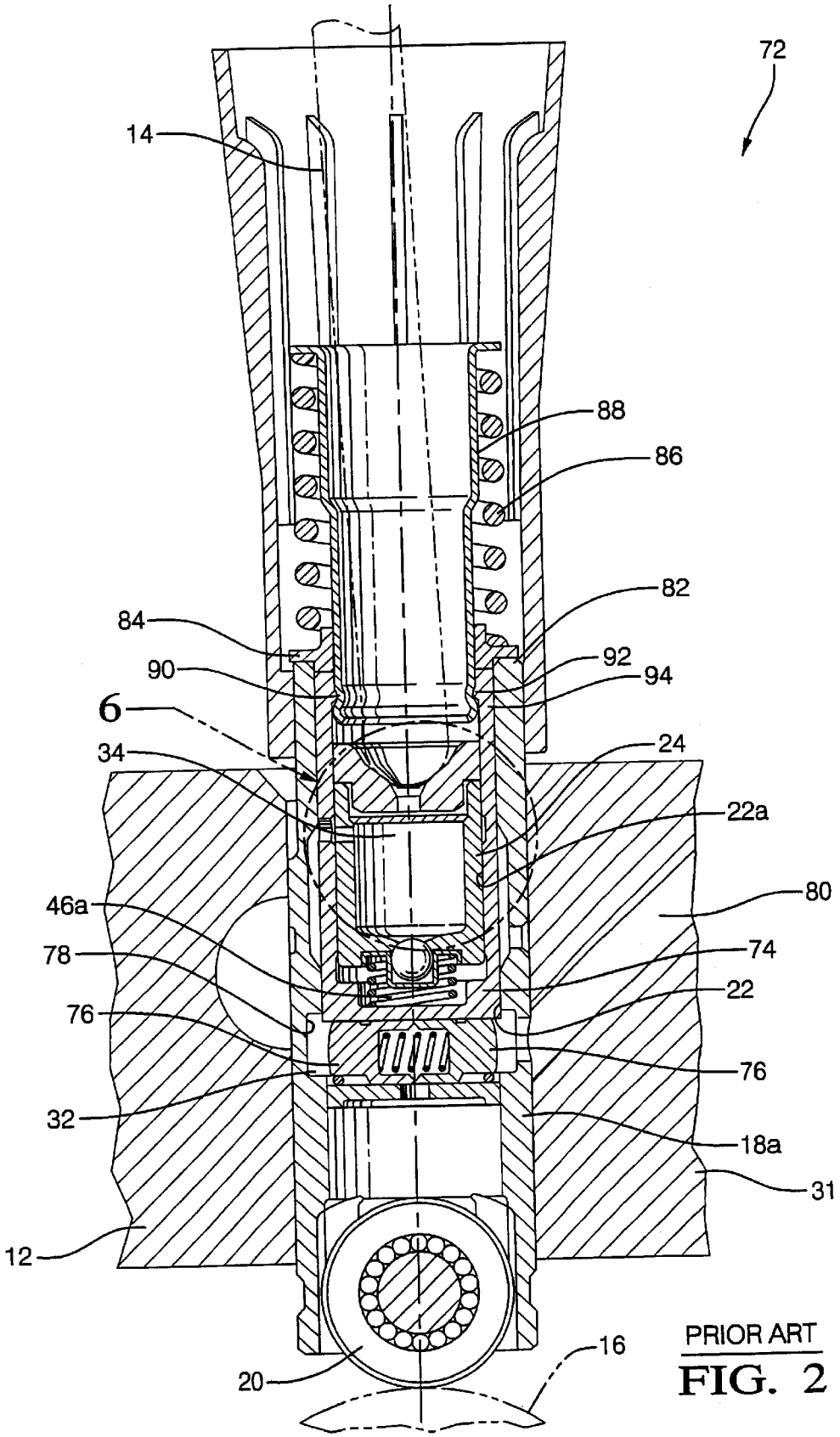
PRIOR ART FIG. 2
FIG. 2 is an elevational cross-sectional view of a prior art hydraulic valve lifter having valve deactivating means.

Referring to FIG. 2, a second prior art hydraulic lifter 72 includes means for decoupling the rotation of cam lobe 16 from the linear motion of pushrod 14. Such decoupling is known in the art as "valve deactivation."

Most of the components of lifter 72 are analogous to those in lifter 10. The principal differences are that a pin housing 74 having a secondary well 22*a* is disposed in well 22 between outer body 18 and plunger 24. The high-pressure chamber 46*a* thus is formed between plunger 24 and secondary well 22*a*. The deactivation mechanism includes radially-acting opposed pins 76 disposed transversely in pin housing 74 and biased outwards for selectively engaging into an annular groove 78 formed in an inner wall of outer body 18 and responsive to programmed supply of activating pressurized oil via passage 80.

When pins 76 are engaged in groove 78, as shown in FIG. 2, lifter 72 functions identically with lifter 10 to actuate pushrod 14 in response to cam lobe 16. Alternatively, when deactivation is desired, oil is supplied to groove 78, forcing pins 76 inwards of pin housing 74, thereby disengaging pin housing 74 and plunger 24 from outer body 18 and decoupling the action of pushrod 14 from rotation of cam 16. In operation during deactivation mode, outer body 18 continues to be responsive to cam lobe 16, but the motion is not transmitted to pin housing 74 and plunger 24, and thus pushrod 14 remains motionless.

In an engine including lifter 10, the lifter is urged to return, after the cam lobe passes, by the pushrod responsive to compression stored in the valve spring. In an engine including lifter 72, lifter outer body 18*a* is urged to return, after the cam lobe passes, by the force of lost motion spring 86. Outer body 18*a* is provided at its upper end 82 with a spring seat 84 for receiving lost-motion compression spring 86 which is captured by tower 88 inserted into the upper end of pin housing 74. In lifter deactivation mode, upward motion of outer body 18 compresses spring 86 against tower 88, which, being attached to pin housing 74, remains motionless. Spring 86 thus urges outer body 18 to return after the cam eccentric passes the lifter.

Tower 88 is captured into pin housing 74 by, for example, a blind snap ring 90 disposed both in a groove 92 formed in tower 88 and an opposed groove 94 formed in pin housing 74. During assembly, ring 90 is compressed into groove 92, tower 88 is inserted into pin housing 74, and ring 90 then expands into groove 94.

Figure 7:
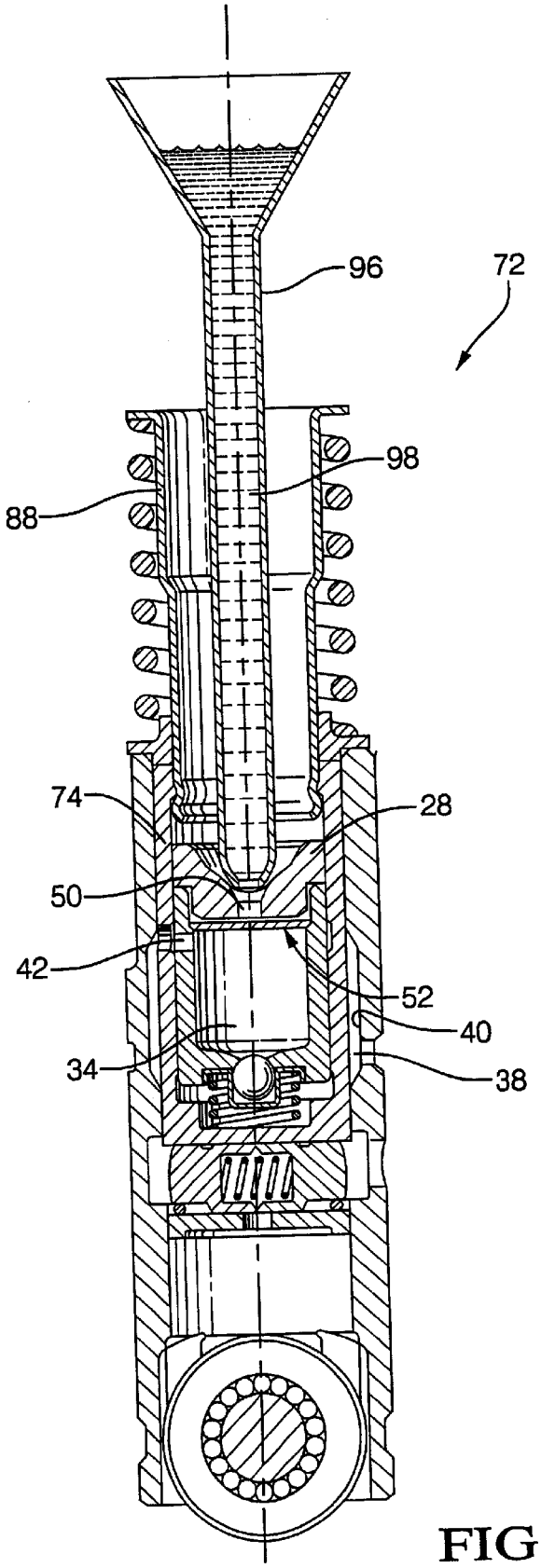
FIG. 7 is an elevational cross-sectional view of a hydraulic valve lifter including an oil metering system in accordance with the invention, showing filling of the lifter with oil in a method in accordance with the invention.

Prior to insertion of the tower into the pin housing, the high-pressure chamber 46*a* and low-pressure chamber 34 are filled to a predetermined degree with lubricants suitable for the initial startup of an assembled engine. It is a problem in the prior art that insertion of tower 88 into pin housing 74 frequently causes some amount of the lubricants to be inadvertently and undesirably expelled from the lifter. Incorporation of an oil metering system 52 in accordance with the invention permits injection of replacement oil into the lifter assembly. Referring to FIG. 7, as a corrective measure after assembly of the lifter, the lifter assembly 72 is oriented with its longitudinal axis preferably vertical, tower 88 being at the top. Oil injection means, for example, funnel 96, is inserted through tower 88 into pushrod seat 28, and oil 98 is injected through axial passage 50 and through the metering system into low-pressure chamber 34 in a reverse direction to displace air out of chamber 34 through first and second passages 38, 42 and distributor 40, thereby ensuring that each lifter has the correct amount of lubricant at the conclusion of assembly. When the oil loss during assembly is systematic, the same amount of replacement oil may be required for every lifter assembly, in which case the injection means may be configured or programmed to deliver a predetermined amount of oil. While the lifter assembly as shown in FIG. 6 includes a valve deactivation means, it is understood that the method of filling low-pressure chamber 32 can be applied to a lifter of the type shown in FIGS. 1 and 1*a*.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An oil flow metering system in a hydraulic valve lifter having a pushrod seat for actuating a pushrod responsive to rotation of a cam lobe, comprising:

a) means for metering the flow of oil in a first direction through said pushrod seat; and b) means for permitting flow of oil in a second direction opposite to said first direction through said pushrod seat.

2. A system in accordance with claim 1 wherein said means for metering and said means for permitting includes a metering plate disposed adjacent to said pushrod seat.

3. A system in accordance with claim 2 wherein said means for permitting includes a feature formed in said lifter for supporting said metering plate therein.

4. A system in accordance with claim 3 wherein said means for permitting includes means for preventing a sealing relationship between said metering plate and said supporting feature.

5. A system in accordance with claim 4 wherein said means for preventing is a metering plate having at least one notch in its periphery.

6. A system in accordance with claim 4 wherein said means for preventing is a metering plate having at least one aperture therethrough.

7. A system in accordance with claim 4 wherein said means for preventing is a metering plate having at least one nonplanar area along its edge.

8. A system in accordance with claim 4 wherein said means for preventing is a metering-plate supportive feature having at least one irregularity.

9. A system in accordance with claim 2 wherein said metering plate is planar, said pushrod seat includes an axial passage therethrough, and said pushrod seat has a curved surface facing said metering plate and intersecting said axial passage.

10. A hydraulic valve lifter for use in an internal combustion engine, the lifter comprising:

an oil flow metering system having a pushrod seat for actuating a pushrod responsive to rotation of a cam lobe in said engine, said oil flow metering system including means for metering the flow of oil in a first direction through said pushrod seat; and means for permitting flow of oil in a second direction opposite to said first direction through said pushrod seat.

11. A hydraulic valve lifter in accordance with claim 10 further comprising valve deactivation means.

12. An internal combustion engine, comprising:

a hydraulic valve lifter, the lifter including an oil flow metering system having a pushrod seat for actuating a pushrod responsive to rotation of a cam lobe in said engine, and means for metering the flow of oil in a first direction through said pushrod seat; and means for permitting flow of oil in a second direction opposite to said first direction through said pushrod seat.

13. A method for entering oil into a chamber in a hydraulic valve lifter assembly, the lifter assembly having a pushrod seat having a passage therethrough in communication with the chamber through a metering system having means for metering the flow of oil in a first direction through the pushrod seat and means for permitting flow of oil in a second direction opposite to said first direction through the pushrod seat, comprising the steps of:

a) providing injector means having a source of oil;

b) orienting said hydraulic valve lifter assembly such that said pushrod seat is disposed near the top of said assembly;

c) positioning said injector into communication with said pushrod seat; and d) injecting oil through said passage in said pushrod seat and said metering system into said chamber.

14. A method in accordance with claim 13 wherein a predetermined amount of oil is so injected into said chamber.

15. A method in accordance with claim 13 wherein said hydraulic valve lifter assembly includes a valve deactivation means.

16. An oil flow metering system in a hydraulic valve lifter having a pushrod seat for actuating a pushrod responsive to rotation of a cam lobe, comprising:

a) means for metering the flow of oil in a first direction through said pushrod seat; and b) means for permitting flow of oil in a second direction opposite to said first direction through said pushrod seat, wherein said means for metering and said means for permitting includes a metering plate disposed adjacent to said pushrod seat, wherein said means for permitting includes a feature formed in said lifter for supporting said metering plate therein, wherein said means for permitting includes means for preventing a sealing relationship between said metering plate and said supporting feature, and wherein said means for preventing is a metering plate having at least one notch in its periphery.

* * * * *